US005798305A

United States Patent [19]

Horiuchi

[11] Patent Number: 5,798,305

[45] Date of Patent: Aug. 25, 1998

[54] HOT-MELT-ADHESIVE CONJUGATE FIBERS AND A NON-WOVEN FABRIC USING THE FIBERS

[75] Inventor: Shingo Horiuchi, Moriyama, Japan

[73] Assignee: Chisso Corporation, Osaka, Japan

[21] Appl. No.: 909,952

[22] Filed: Aug. 12, 1997

Related U.S. Application Data

[63] Continuation-in-part of Ser. No. 496,689, Jun. 29, 1995, abandoned.

[30] Foreign Application Priority Data

Jul. 4, 1994 [JP] Japan ..... 6-175945
Oct. 21, 1994 [JP] Japan ..... 6-283011

[51] Int. Cl.[6] ..... D02G 3/00

[52] U.S. Cl. ..... 442/361; 442/362; 428/373; 428/374

[58] Field of Search ..... 428/373, 374, 428/370; 442/361, 362, 364

[56] References Cited

U.S. PATENT DOCUMENTS

| | | | |
|---|---|---|---|
| 4,315,881 | 2/1982 | Nakajima et al. . | |
| 4,552,603 | 11/1985 | Harris, Jr. et al. | 428/373 |
| 4,788,264 | 11/1988 | Ukita | 525/285 |
| 5,444,145 | 8/1995 | Brant | 526/348.3 |

FOREIGN PATENT DOCUMENTS

| | | |
|---|---|---|
| 260607 | 3/1988 | European Pat. Off. . |
| 334579 | 9/1989 | European Pat. Off. . |
| 391260 | 10/1990 | European Pat. Off. . |
| 2498634 | 7/1982 | France . |
| 90-346168 | 10/1990 | Japan . |
| 93-270136 | 7/1993 | Japan . |
| 92-371163 | 8/1991 | Rep. of Korea . |

*Primary Examiner*—Newton Edwards
*Attorney, Agent, or Firm*—Fay, Sharpe, Beall, Fagan, Minnich & McKee

[57] ABSTRACT

A non-woven fabric having a high strength, a good bulkiness and a soft feeling, and hot-melt-adhesive conjugate fibers affording the non-woven fabric are provided, the above hot-melt-adhesive conjugate fibers being composed of conjugate fibers, of side-by-side type or sheath-and-core type, composed of a high melting component of a polypropylene or a polyester and a low melting component of a polyethylene, the polyethylene continuously forming at least one portion of the fiber surface in the direction of the fibers; hot-melt-adhesive conjugate fibers characterized in that the polyethylene has 0 to 1.5 methyl branch/1000 C in the molecular chain, a density of 0.950 to 0.965 g/cm 3 and a Q value (weight average molecular weight (Mw)/number average molecular weight (Mn)) of 4.5 or less, and the above hot-melt-adhered non-woven fabric being characterized by containing 20% by weight or more of the above hot-melt-adhesive conjugate fibers.

5 Claims, No Drawings

HOT-MELT-ADHESIVE CONJUGATE FIBERS AND A NON-WOVEN FABRIC USING THE FIBERS

This application is a continuation-in-part of application Ser. No. 08/496,689, filed Jun. 29, 1995, now abandoned.

BACKGROUND OF THE INVENTION

1. Field of Commercial Utilization

This invention relates to hot-melt-adhesive conjugate fibers and a non-woven fabric using the conjugate fibers.

2. Description of the Related Prior Art

Non-woven fabrics having a basis weight of about 10 to 45 g/m$^2$ have been used as the surface materials for paper diaper, goods for menstruation, etc. Further, performances required for non-woven fabrics have been highly elevated due to the diversification of the use applications of non-woven fabrics, and non-woven fabrics maintaining the high strength thereof in a weight as small as possible and a soft feeling have been required, and further, those abundant in the bulkiness depending upon the use applications have been required.

In order to satisfy these requirements, it has been regarded as necessary conditions that the non-woven fabrics are composed of hot-melt-adhesive conjugate fibers having a small fineness, and the low melting component contributing to hot-melt-adhesion of hot-melt-adhesive conjugate fibers displays a sufficient adhesion strength and also has softness.

As examples of hot-melt-adhesive conjugate fibers, those of combinations of polypropylene/polyethylene, polyethylene terephthalate/polyethylene, and polyethylene terephthalate/poly [(ethyleneterephthalate)-co-(ethyleneisophthalate)] have been known. As polyethylene, high density polyethylene, low density polyethylene, linear low density polyethylene, etc. have been used.

However, hot-melt-adhesive conjugate fibers using low density polyethylene or linear low density polyethylene as the low melting component thereof have a merit that the resulting non-woven fabric has a soft feeling, but in general, the fibers have a low stiffness due to the low density so that the strength of the resulting non-woven fabrics have a low strength and are difficultly made bulky. For example, Japanese patent application laid-open No. Sho 63-92722 discloses hot-melt-adhesive conjugate fibers using a polyester as the high melting component and a linear low density polyethylene having a low stiffness, as the low melting component, and a hot-melt-adhesive non-woven fabric composed of the conjugate fibers, but the non-woven fabric has a low strength and bulkiness; hence the required performances aimed in the present invention are not satisfied.

On the other hand, hot-melt-adhesive conjugate fibers using a high density polyethylene as the low melting component thereof, they usually have a higher density and a higher stiffness than those of low density polyethylene or linear low density polyethylene, to afford a non-woven fabric having a higher strength, but the, high density polyethylene as the low melting component has a higher melting point; hence in order to afford a non-woven fabric having a high strength, it is necessary to elevate the processing temperature of the fabric. Thus, when polypropylene is particularly used as the high melting component, the bulkiness of the resulting non-woven fabric is lowered due to its heat yielding property. Further, there is a drawback that the feeling of the non-woven fabric is liable to become hard. Further, the processing temperature of the non-woven fabric is preferred to be lower in the aspect of energy cost, but when the temperature is insufficiently, a high non-woven fabric having a sufficient strength cannot be obtained.

SUMMARY OF THE INVENTION

Problem to be Solved

The object of the present invention is to provide a non-woven fabric having overcome the above drawbacks of the prior art, and having a high strength, a good bulkiness and a soft feeling, and also to provide hot-melt-adhesive conjugate fibers enabling to afford the above non-woven fabric.

Means for Solving the Problem

The present inventors have made extensive research in order to solve the above problem, and as a result, have found that when hot-melt-adhesive conjugate fibers obtained by using a specific polyethylene as the low melting component of the fibers are processed into a non-woven fabric, the resulting non-woven fabric has a high strength, a good bulkiness and a soft feeling. Thus, we have found that the aimed object can be achieved and have completed the present invention.

The present invention has the following compositions:

(1) In conjugate fibers of side-by-side type or sheath-and-core type, composed of a high melting component of a polypropylene or a polyester and a low melting component of a polyethylene, said polyethylene continuously forming at least one portion of the fiber surface in the direction of the fibers, hot-melt-adhesive conjugate fibers characterized in that said polyethylene has 0 to 1.5 methyl branch/ 1,000 C in the molecular chain, a density of 0.950 to 0.965 g/cm$^3$ and a Q value (weight average molecular weight (Mw)/number average molecular weight (Mn)) of 4.5 or less.

(2) Hot-melt-adhesive conjugate fibers according to item (1), wherein said polyethylene is a homopolyethylene.

(3) Hot-melt-adhesive conjugate fibers according to item (1), wherein said polyethylene is a copolymer of ethylene with an α-olefin of 4 or more carbon atoms.

(4) A non-woven fabric containing 20% by weight or more of the following hot-melt-adhesive conjugate fibers and having the points of intersections of the fibers hot-melt-adhered with the polyethylene as the low melting component in the conjugate fibers of the hot-melt-adhesive conjugate fibers:

said hot-melt-adhesive conjugate fibers, in conjugate fibers of side-by-side type or sheath-and-core type, composed of a high melting component of a polypropylene or a polyester and a low melting component of a polyethylene, said polyethylene continuously forming at least one portion of the fiber surface in the direction of the fibers, characterized in that said polyethylene has 0 to 1.5 methyl branch/1,000 C in the molecular chain, a density of 0.950 to 0.965 g/cm$^3$ and a Q value (weight average molecular weight (Mw)/number average molecular weight (Mn)) of 4.5 or less.

(5) A non-woven fabric according to item (4), wherein said polyethylene is a copolymer of ethylene with an α-olefin of 4 or more carbon atoms.

The present invention will be described in more detail.

The polypropylene used as a high melting component of the hot-melt-adhesive conjugate fibers in the present invention is a crystalline polymer composed mainly of propylene and may be propylene homopolymer or a copolymer of propylene with a small quantity of another α-olefin (such as ethylene, butene-1, etc.), and is preferred to be those having a melting point of 158° C. or higher, and a melt flow rate (MFR: 230° C., ASTM D1238 (L)) of 5 to 40. Such a polymer can be obtained by polymerizing propylene (and a small amount of another α-olefin) in the presence of Ziegler-Natta catalyst, Kaminski type catalyst or the like, according to a production process such as slurry method, bulk method, gas phase method, etc.

The polyester used as another of the high melting component of the hot-melt-adhesive conjugate fibers in the present invention is a thermoplastic polyester generally used as a raw material for fibers. For example, it may be polyethylene terephthalate and besides, copolymers such as poly [(ethyleneterephthalate)-co-(ethyleneisophthalate), and those having a melting point of 250° to 260° C. and an intrinsic viscosity of 0.5 to 1.2 (in phenol/tetrachloroethane, at 30° C. ) are preferred.

As to the polyethylene used in the present invention, it is necessary to adjust its density to 0.950 to 0.965 g/cm$^2$. If the density exceeds 0.965 g/cm$^2$, the non-woven fabric obtained from hot-melt-adhesive conjugate fibers has a high strength due to the high stiffness of the low melting component, but since the melting point of the low melting component is high, it is necessary to elevate the processing temperature of the non-woven fabric.

In the case of conjugate fibers of polyethylene with polypropylene, since the softening point of polypropylene is close to the melting point of the polyethylene, if the processing temperature of the non-woven fabric is high, the influence upon polypropylene becomes large; hence heat-yielding of the non-woven fabric occurs, so that a bulky non-woven fabric cannot be obtained and also its feeling is liable to be hard. To the contrary, if the desnity of the polyethylene is lower than 0.950 g/cm$^3$, the non-woven fabric obtained from the hot-melt-adhesive fibers has a soft feeling, but since the stiffness of the low melting component is low, a high strength cannot be obtained; hence such a polyethylene cannot be used. In both of the aspects of the strength and feeling of the non-woven fabric, the density of the polyethylene is more preferably 0.955 to 0.961 g/cm$^3$. In addition, the density referred to herein can be measured by preparing a sample piece according to the pressing method of JIS K-6758 and measuring the piece according to the density gradient tube method of JIS K-7112.

The Q value of the polyethylene used in the present invention is necessary to be 4.5 or less. A more preferable range is 3.7 or less. If the Q value exceeds 4.5, when the fibers are heat-treated and adhered to obtain the non-woven fabric, since the polyethylene which is a low melting component melted in the fibers has a broad molecular weight distribution; the tensile strength of the fabric lowers, so that the melt adhesion of the low melting component at the points of intersection of the fibers with each other formed by the high melting component of the fibers is insufficient; hence a non-woven fabric having a high strength cannot be obtained.

The Q value referred to herein means the ratio of the weight average molecular weight to the number average molecular weight measured by way of gel permeation chromatography in an o-dichlorobenzene solution at 140° C.

Further, the polyethylene used in the present invention has a methyl branch of 0 to 1.5/1000 C in the molecular chain, and a methyl branch as small as 0 to 0.5/1000 C is more preferable. The methyl branch referred to herein means a methyl group directly branched from the main chain of the polyethylene, and methyl group not directly bonded to the main chain, like an end methyl group of ethyl branch is not included therein. The number of methyl branches is represented by the number of methyl groups directly bonded to the main chain, per 1000 carbon atoms of the main chain of the polyethylene. Such methyl groups can be determined by way of nuclear magnetic resonance spectrum of carbon atom having a mass number of 13.

The number of methyl branch of 0 in the present invention refers to, in the case of copolymer polyethylene, a state where a long chain branch other than methyl branch, such as ethyl branch, n-butyl branch, etc. is contained. Homopolyethylene, which is not a copolymer, refers to ethylene homopolymer having substantially no branch, as described below.

As seen from the linear low density polyethylene, the copolymer polyethylene is reduced in the density if not only the number of methyl branch, but also the number of branch increase. If it is intended to obtain the density range defined in the present invention, by increasing only the number of methyl branch, then the point of branch increases relative to the main chain of polyethylene, as compared with the case where a branch longer than methyl branch is used. Further, if the length of branch is short, a structure similar to a linear one is obtained, and the molecule is not compact and the viscosity at the time of melting increases to make the fluidity inferior. When a non-woven fabric is obtained by heat-treating and adhering hot-melt-adhesive fibers using a polyethylene having a methyl branch of 1.5 or more/1000 C as the low melting point component, the adhesion of the low melting component at the points of intersection of fibers with each other, formed by the high melting component, is insufficient; hence a non-woven fabric having a high strength cannot be obtained. As described above, in order to lower the density of polyethylene while retaining the adhesion of non-woven fabric, ethyl branch or branch longer than ethyl branch is preferred. Further, in the case of conjugate fibers of polyethylene with polypropylene, since the softening point of polypropylene is close to the melting point of polyethylene, if the fluidity of polyethylene is inferior, the heat influence upon polypropylene enhances to cause the heat yeidling of the non-woven fabric; hence a bulky non-woven fabric cannot be obtained.

The copolymer polyethylene satisfying the above conditions can be obtained by copolymerizing ethylene with a small quantity of an α-olefin in the presence of Ziegler-Natta catalyst, chronium oxide system catalyst, molybdenum oxide system catalyst, Kaminski type catalyst or the like, according to a production process such as conventional solution method or gas phase method or high temperature and high pressure ionic polymerization method or the like.

A small quantity of an α-olefin herein used as a comonomer refers to propylene forming methyl branch, and 1-olefins of 4 carbon atoms or more forming a branch longer than methyl branch such as butene-1, pentene-1, hexene-1, 4-methylpentene-1, heptene-1, octene-1, nonene-1, decene-1, etc. Even if propylene is not used, other olefins may be used within a range wherein the number of methyl branch of 1.5 or less/1000 C is afforded, and as to other olefins, the polymer may be a multi-component consisting of not only one kind but also two or more kinds of olefins and having a density and a Q value falling within the respective ranges defined in the present invention.

Separately from the above, as a polyethylene of the present invention free from any branch formed by comonomers, there is a homo-polyethylene which is an ethylene homopolymer. In the case of such homo-polyethylene having a melt flow rate (MFR at 190° C. : 20)

suitable to fiber production, the density usually exceeds 0.965 g/cm$^3$ and is usually close to 0.970 g/cm$^3$. However, when a homo-polyethylene having a density of 0.950 to 0.965 g/cm3 falling within the range of density of the present invention and a Q value of 4.5 or less is used as a low melting component and hot-melt-adhesive conjugate fibers using the homo-polyethylene are heat-treated and adhered, the resulting non-woven fabric has a high strength as in the case where a homo-polyethylene having a usual, high density is used. Further, when the density and Q value thereof are made to fall within the ranges of the present invention, the resulting non-woven fabric was bulky and had a good feeling. Although the reason is not well known, an example of the production process of this polyethylene was as follows:

the polyethylene could be obtained by singly polymerizing ethylene according to a process under polymerization conditions of high temperature and high pressure according to a high concentration slurry process, in the presence of Ziegler-Natta catalyst endurable to high temperature and high pressure and having a high activity, and for a reaction retention time as very short as several minutes. If the density and Q value fall within the ranges defined in the present invention, an ethylene homopolymer may also be obtained using the above other catalysts and according to another polymerization process. The thus prepared homo-polyethylene having substantially no branch is particularly preferred as a raw material for conjugate fibers of the present invention. In addition, whether or not the polyethylene is homo-polyethylene can be judged according to nuclear magnetic resonance spectrum of carbon atom having a mass number of 13

As to the melt flow rate (MFR: 190° C., ASTM D1238 (E)) of the polyethylene used in the present invention, those of about 5 to 45 are used, but those of 8 to 28 are preferably used in the aspect of easy spinning. Further, in order to prevent deterioration at the time of spinning and prevent discoloration of the resulting non-woven fabric, etc., antioxydant, light-stabilizer, heat-stabilizer and besides, coloring agent, slipping agents, surfactant, delustering agent, etc. added to usual polyolefins are blended, if necessary.

The hot-melt-adhesive conjugate fibers of the present invention are obtained by conjugate-spinning a polypropylene or a polyester as a high melting component and a polyethylene as a low melting component into a side-by-side type or a sheath-and-core type in which the polyethylene constitutes the sheath. In addition, the sheath-and-core type may be either one of a concentric sheath-and-core type or an eccentric sheath-and-core type. As to the component ratio of the high melting component to the low melting component, those in the range of 30/70 to 70/30 by weight are preferred, and those in the range of 40/60 to 65/35 are more preferred. Other spinning and stretching conditions may be those of conjugate fibers consisting of usual combinations of polypropylene/polyethylene or polyester/polyethylene. The fineness of single fibers and the number of crimps have no particular limitation, but in order that the strength and feeling of the non-woven fabric are balanced, a fineness of single filament of 0.5 to 6.0 d and a number of crimps of 5 to 30 crimps/25 mm are preferred, and a fineness of single filament of 1.0 to 3.0 d and a number of crimps of 10 to 20 crimps/25 mm are more preferred.

The non-woven fabric of the present invention is obtained by making a fiber assembly consisting only of hot-melt-adhesive conjugate fibers of the present invention or a blended fiber assembly consisting of 20% by weight or more of the hot-melt-adhesive conjugate fibers and other fibers, into a web, according to known carding process, air-laying process, dry pulp process, wet paper-making process, tow-opening process, etc., followed by heat-treating the web to hot-melt-adhere the contact points of the hot-melt-adhesive conjugate fibers.

As the heat-treating method, any of a method using a dryer such as hot air dryer, suction band dryer, yankee dryer, etc., and a method using press rolls such as flat calender roll, emboss roll, etc. can be used. In order to obtain a more bulky non-woven fabric, hot air dryer or suction band dryer are preferred. The heat-treatment temperature is a temperature of melting point or higher of the low melting component of the conjugate fibers and a melting point or lower of the high melting component thereof, and a range of about 130° to 155° C. is used.

The basis weight of the non-woven fabric has no particular limitation, and can be varied according to use applications, but when the fabric is used as a surface material of diaper or menstruation goods, 8 to 50 g/m$^2$ are preferred and 10 to 30 g/m$^2$ are more preferred.

As other fibers usable by blending with the hot-melt-adhesive conjugate fibers of the present invention, those which do not cause change of properties due to the above heat treatment and inhibit the object of the present invention can be optionally used, and synthetic fibers of polyester, polyamide, polypropylene, polyethylene, etc., natural fibers of cotton, wool, etc., rayon, etc. can be illustrated.

In the non-woven fabric of the present invention, since the low melting component of the hot-melt-adhesive fibers functions as a binder, if the content of the hot-melt-adhesive fibers in the fiber assembly is less than 20% by weight, the hot-melt-adhered points in the points of intersection of fibers are reduced; hence a non-woven fabric having a high strength cannot be obtained.

As to the use applications of the hot-melt-adhesive conjugate fibers and the non-woven fabrics using the same, of the present invention, the conjugate fibers and the non-woven fabrics are suitable to surface materials for paper diaper, menstruation goods, etc. and besides, they can be broadly used as living-related materials, such as medical materials such as surgical gown, civil materials such as drainage material, ground-improving material, etc., industrial materials such as oil-adsorbing material, non-woven fabrics for tray mat used for packaging fresh foods such as fish shellfishe, meats, etc.

EXAMPLE

The present invention will be described in more detail by way of Examples and Comparative examples. In addition, the methods for evaluating physical properties are as follows:

Strength of non-woven fabric:

According to JIS L1085 (a tesing method of an interlining cloth of non-woven fabric), a test piece having a width of 5 cm cut off from a non-woven fabric in the machine direction (MD) and in the direction perpendicular thereto (CD) was prepared and its break strength was measured at a gripping distance of 10 cm and at a tensile velocity of 30±2 cm/min. Unit: Kg/5 cm.

Bulkiness:

A load of 2 g/cm$^2$ was applied to the test piece, and just thereafter its thickness A (mm) was measured. The bulkiness refers to a specific volume (cm$^3$/g) obtained from the ratio of the thickness A to its basis weight B (g/m$^2$) (A/B)×C, wherein C represents a unit amendment (C=1000).

The strength and bulkiness of the non-woven fabric are physical properties contrary to each other, namely, there is a tendency that when the strength is high, the bulkiness is inferior, while when the bulkiness is good, the strength is low. Herein, evaluation was made as follows:

In the case of a non-woven fabric composed totally (100%) of hot-melt-adhesive conjugate fibers, when the strength (S) of the non-woven fabric (CD) is 1.4 Kg or more/5 cm at the time of a bulkiness (specific volume) (B) of 60 to 69 $cm^3/g$, and when the strength (S) of the non-woven fabric (CD) is 1.1 Kg or more/5 cm at the time of a bulkiness (specific volume) (B) of than 70 $cm^3/g$ or more, the non-woven fabrics in these cases were evaluated to be good. Further, in the case where the non-woven fabric is composed of a blend of the hot-melt-adhesive conjugate fibers with other fibers, when the bulkiness (specific volume) (B) is 60 $cm^3/g$ or more and the strength (S) is of the non-woven fabric (CD) is 0.5 Kg/5 cm or higher, such a non-woven fabric was evaluated to be good. A product (S·B) of a strength (S) and a bulkiness (B) of a non-woven fabric is thought to be a measure for evaluating both properties (strength and bulkiness) of the non-woven fabric. The product (S·B) is preferable to be 77 or more.

Feeling of non-woven fabric:

An organoleptic test was carried out by 5 panellers. When all members judged that there was no rustling feeling due to wrinkles and the sample was soft, the fabric was evaluated to be good (o), when three members or more judged as above, the fabric was evaluated to be fairly good (Δ), and when three members or more judged that the fabric had a rustling feeling due to wrinkles, etc. or was deficient in the softness, the fabric was evaluated to be not good (x).

EXAMPLES 1 AND 2 AND COMPARATIVE EXAMPLES 1 TO 4

Conjugate fibers of a sheath-and-core type wherein a polypropylene constituted the core and a polyethylene constituted the sheath and the ratio of sheath to core is 1:1, and having a single filament denier of 7.5 d/f, were obtained by spinning under the following conditions:

a polypropylene (MFR: 16) as a high melting component, and its extrusion temperature: 280° C.;

a high density polyethylene (excluding Comparative example 2), or a linear low density polyethylene (Comparative example 2) as a low melting component, each indicated in Table 1; the total extrusion temperature of the high density polyethylene:

220C; the total extruded quantity of both the components: 200 g/min; and a sheath-and-core type spinning die having a nozzle diameter of 0.6 mm and a number of nozzles of 350.

The resulting unstretched fibers were stretched to 3.75 times the original length, followed by crimping, heat-treating at 100° C. in order to prevent shrinkage, and cutting the length to 51 mm to obtain a hot-melt-adhesive conjugate fiber staple. However, stretching was carried out at 90° C. only in Comparative example 2. The above staple was passed through a carding machine, followed by heat-treating the resulting web at 140° C. by means of a suction band dryer, to obtain a non-woven fabric having the points of intersection of the hot-melt-adhesive fibers hot-melt-adhered.

However, heat-treatment was carried out at 143° C. in Comparative example 1 and at 130° C. in Comparative example 2. The characteristics, of raw material polyethylene, non-woven fabric-making conditions and characteristics of non-woven fabric are shown in the following Table 1 and Table 2:

TABLE 1

| | Physical properties of fibers | | | | | | |
|---|---|---|---|---|---|---|---|
| | High melting component | Low melting component | | | | | Shape of conjugate fiber |
| | | Kind *1 | MFR g/10 min. | Me branch /1000C | Density $g/cm^3$ | Q value Mw/Mn | |
| Example 1 | PP | A1 | 19 | <0.5 | 0.961 | 3.5 | Sheath and core |
| Example 2 | PP | A2 | 17 | 0.8 | 0.955 | 4.1 | " |
| Comp.ex.1 | PP | a1 | 15 | <0.5 | 0.968 | 4.4 | " |
| Comp.ex.2 | PP | b | 18 | <0.5 | 0.925 | 6.2 | " |
| Comp.ex.3 | PP | a2 | 19 | 0.8 | 0.956 | 5.6 | " |
| Comp.ex.4 | PP | a3 | 16 | 6.6 | 0.951 | 3.9 | " |
| Example 3 | PET | A3 | 16 | 1.0 | 0.956 | 4.2 | " |
| Example 4 | PET | A1 | 19 | <0.5 | 0.961 | 3.5 | " |
| Comp.ex.5 | PET | a4 | 14 | 7.1 | 0.948 | 3.8 | " |
| Comp.ex.6 | PET | a5 | 16 | 4.0 | 0.955 | 4.0 | " |
| Comp.ex.7 | PET | c | 19 | 12.7 | 0.920 | 6.5 | " |
| Example 5 | PP | A1 | 19 | <0.5 | 0.961 | 3.5 | Side by side |
| Example 6 | PP | A4 | 26 | 0.8 | 0.958 | 3.7 | " |
| Comp.ex.8 | PP | a5 | 16 | 4.0 | 0.955 | 4.0 | " |
| Comp.ex.9 | PP | A1 | 19 | <0.5 | 0.961 | 3.5 | " |

*1: Kind A: high density polyethylene corresponding to the present invention (affix letter: identification number)
a: high density polyethylene not corresponding to the present invention (affix letter: identification number)
b: linear low density polyethylene
c: low density polyethylene

TABLE 2

| | Non-woven fabric-making conditions | | | Physical properties of non-woven fabric | | | | | |
|---|---|---|---|---|---|---|---|---|---|
| | Mixing percentage | Other fibers | Treating temp. | Basis weight of non-woven fabric | Strength of non-woven fabric Kg/5 cm | | Bulkiness (B) | | |
| | % | | °C. | g/m² | MD | CD(S) | cm³g | Feeling | S · B |
| Example 1 | 100 | — | 140 | 21 | 7.5 | 1.7 | 68 | ○ | 115.6 |
| Example 2 | 100 | — | 140 | 19 | 7.0 | 1.4 | 65 | ○ | 91 |
| Comp.ex.1 | 100 | — | 143 | 21 | 7.8 | 1.7 | 45 | x | 76.5 |
| Comp.ex.2 | 100 | — | 130 | 22 | 5.2 | 0.8 | 51 | ○ | 40.8 |
| Comp.ex.3 | 100 | — | 140 | 20 | 6.4 | 1.0 | 56 | ○ | 56 |
| Comp.ex.4 | 100 | — | 140 | 20 | 6.2 | 0.9 | 53 | ○ | 47.7 |
| Example 3 | 100 | — | 140 | 22 | 4.9 | 1.1 | 73 | ○ | 80.3 |
| Example 4 | 100 | — | 140 | 20 | 5.3 | 1.3 | 76 | ○ | 98.8 |
| Comp.ex.5 | 100 | — | 140 | 19 | 3.9 | 0.7 | 62 | ○ | 43.4 |
| Comp.ex.6 | 100 | — | 140 | 21 | 4.3 | 0.9 | 65 | ○ | 58.5 |
| Comp.ex.7 | 100 | — | 130 | 22 | 2.3 | 0.5 | 57 | ○ | 28.5 |
| Example 5 | 25 | PET | 140 | 31 | 2.2 | 0.5 | 60 | Δ | — |
| Example 6 | 25 | PET | 140 | 29 | 1.9 | 0.5 | 63 | Δ | — |
| Comp.ex.8 | 25 | PET | 140 | 30 | 1.5 | 0.2 | 54 | Δ | — |
| Comp.ex.9 | 15 | PET | 140 | 29 | 1.7 | 0.3 | 56 | Δ | — |

As seen from these results, the non-woven fabrics obtained by using conjugate fibers of Example 1 and Example 2 of the present invention have high strengths in both of the longitudinal direction (MD) and the lateral direction (CD), a good bulkiness and a good feeling. Whereas, the non-woven fabrics obtained by using the conjugate fibers of Comparative examples 1 to 4 have a weak strength in the lateral direction (CD) or an inferior bulkiness or feeling.

EXAMPLES 3 AND 4 AND COMPARATIVE EXAMPLES 5 TO 7

Conjugate fibers of a sheath-and-core type wherein a polyester constituted the core and a polyethylene constituted the sheath and the component ratio is 6:4, and having a single filament denier of 6.7 d/f were obtained by spinning under the following conditions:

a polyester (polyethylene terephthalate: PET, intrinsic viscosity: 0.65) as a high melting point component, and its extrusion temperature: 300° C.;

a high density polyethylene (excluding Comparative example 7) and a low density polyethylene (Comparative example 7), each as a low melting component, shown in Table 1; the total extrusion temperature of the high density polyethylene: 200° C.; the total extruded quantity of both the components: 282 g/min.; and a spinning die of sheath-and-core type having a nozzle diameter of 0.6 mm and a number of nozzles of 350.

The resulting unstretched fibers were stretched to 3.3 times the original length at 90° C., followed by crimping, heat-treating at 80° C. in order to prevent shrinkage and cutting to a cut length of 51 mm to obtain a hot-melt-adhesive conjugate fiber staple.

This staple was passed through a carding machine, followed by heat-treating the resulting web at 140° C. by means of a suction band dryer to obtain a non-woven fabric having the points of intersection of the hot-melt-adhesive fibers hot-melt-adhered. However, in the case of Comparative example 7, heat-treatment was carried out at 130° C. The characteristics, non-woven fabric-making conditions of the raw material polyethylene polymer, the characteristics of the resulting non-woven fabric, etc. are shown in Table 1 and Table 2

As seen from the results, the non-woven fabrics obtained by using the conjugate fibers of Examples 3 and 4 according to the present invention had high strengths in both of the longitudinal direction (MD) and the lateral direction (CD), a good bulkiness and a good feeling. Whereas, the non-woven fabrics obtained by using the conjugate fibers of Comparative examples 5 to 7 had a weak strength in the lateral direction (CD) or an inferior bulkiness.

EXAMPLES 5 AND 6 AND COMPARATIVE EXAMPLES 8 AND 9

Conjugate fibers of a side-by-side type wherein the ratio of the components was 1:1, and having a single filament denier of 12 d/f, were obtained by spinning under the following conditions:

a polypropylene (MFR: 12) as a high melting component and its extrusion temperature: 300° C.; a high density polyethylene shown in Table 1, as a low melting component and its extrusion temperature of 200° C; the total extruded quantity of both the components: 200 g/min.; and a spinning die of side-by-side type having a nozzle diameter of 0.6 mm and a number of nozzles of 350.

The resulting unstretched filaments were stretched to 4 times the original length at 110° C., followed by crimping, heat-treating at 100° C. for 5 minutes in order to prevent shrinkage and cutting to a cut length of 38 mm to obtain a hot-melt-adhesive conjugate fiber staple.

The thus obtained hot-melt-adhesive conjugate fiber staple (15 to 25% by weight) was optionally blended with a polyethylene terephthalate fiber staple having a single filament denier of 6 d/f and a filament length of 51 mm (85 to 75% by weight), followed by passing the blend through a carding machine and heat-treating the resulting web at 140° C. for 5 seconds by means of a suction band dryer to obtain a non-woven fabric having the points of intersection of the hot-melt-adhesive fibers hot-melt-adhered. The characteristics of the raw material polyethylene, the non-woven fabric-making conditions and the characteristics of the non-woven fabric are shown in Table 1 and Table 2.

As seen from the results, the hot-melt-adhesive non-woven fabrics containing 20% by weight or more of the conjugate fibers of Examples 5 and 6 according to the present invention are superior in the strength, bulkiness and feeling. However, even when the non-woven fabric obtained by using the conjugate fibers of comparative example 8 and the hot-melt-adhesive non-woven fabric of Comparative example 9 which uses the conjugate fibers of the present invention but does not contain 20% by weight or more of the conjugate fibers, both have a weak, lateral strength (CD).

EXAMPLES 7 AND 8 AND COMPARATIVE EXAMPLES 10 AND 11

Conjugate fibers of sheath-and-core type wherein a polypropylene constitutes the core and a polyethylene constitutes the sheath, and having a sheath to core ratio of 1:1 and a single fiber denier of 7.5 d/f were obtained by spinning under the following conditions:

a polypropylene (MFR: 14) as the high melting component, and its extrusion temperature: 280° C.;

a high density polyethylenes as a low melting component, respectively shown in Table 3; the extrusion temperatures of the high density polyethylene: all 220° C.; the total extruded quantity of both the components: 200 g/min; and spinning die of sheath-and-core type: nozzle diameter of 0.6 mm and number of nozzles of 350.

The resulting unstretched filaments were stretched to 3.75 times the original length at 110° C., followed by crimping, heat-treating at 100° C. in order to prevent shrinkage and cutting to a cut length of 51 mm, to obtain a hot-melt-adhesive conjugate fiber staple. The thus obtained hot-melt-adhesive conjugate fiber staple was passed through a carding machine, followed by heat-treating the resulting web at 140° C. by means of a suction band dryer to obtain a non-woven fabric having the points of intersection of the hot-melt-adhesive fibers hot-melt-adhered. However, in the case of Comparative example 11, heat-treatment was carried out at 143° C. The characteristics of the raw material polyethylene, the non-woven fabric-making conditions and the characteristics of the non-woven fabrics are shown in Table 3 and Table 4.

TABLE 3

| | High | Physical properties of fibers Low melting component | | | | | | |
|---|---|---|---|---|---|---|---|---|
| | melting component | Kind *2 | MFR g/10 min | Me branch /1000C | Long chain branch /1000C*3 | Density g/cm³ | Q value Mw/Mn | Shape of conjugate fibers |
| Example 7 | PP | A1 | 18 | 0.0 | 1.4 (C6) | 0.955 | 4.3 | Sheath-and-core type |
| Example 8 | PP | A'1 | 19 | 0.0 | 0.0 | 0.960 | 3.7 | Sheath-and-core type |
| Comp.ex.10 | PP | a1 | 15 | 0.0 | 2.2 (C4) | 0.953 | 4.9 | Sheath-and-core type |
| Comp.ex.11 | PP | a'1 | 18 | 0.0 | 0.0 | 0.969 | 5.8 | Sheath-and-core type |
| Example 9 | PP | A2 | 21 | 0.0 | 1.2 (C4) | 0.956 | 4.0 | Side by side type |
| Example 10 | PP | A'2 | 23 | 0.0 | 0.0 | 0.958 | 3.6 | Side by side type |
| Comp.ex.12 | PP | a2 | 19 | 0.0 | 0.9 (C4) | 0.959 | 5.2 | Side by side type |
| Comp.ex.13 | PP | A'2 | 23 | 0.0 | 0.0 | 0.958 | 3.6 | Side by side type |

*2: Kind A: Copolymer polyethylene corresponding to the present invention (affix letter: identification number)
A': Homopolyethylene corresponding to the present invention (affix letter: identification number)
a: Copolymer polyethylene not corresponding to the present invention (affix letter: identification number)
a': Homopolyethylene not corresponding to the present invention (affix letter: identification number)
*3: long chain branch (ethyl branch or branch of alkyl higher than ethyl branch) The symbol in the parentheses shows species of branch C4: ethyl branch C6: n-butyl branch

TABLE 4

| | Non-woven fabric-making conditions | | | Physical properties of non-woven fabric | | | | | |
|---|---|---|---|---|---|---|---|---|---|
| | Blending proportion | Other | Treating temp. | Basis weight of non-woven fabric | Strength of non-woven fabric Kg/5 cm | | Bulkiness (B) | | |
| | % | fiber | °C. | g/m² | MD | CD (S) | cm³/g | Feeling | S · B |
| Example 7 | 100 | — | 140 | 22 | 7.4 | 1.7 | 67 | ○ | 113.9 |
| Example 8 | 100 | — | 140 | 20 | 7.7 | 1.8 | 69 | ○ | 124.2 |
| Comp.ex.10 | 100 | — | 140 | 19 | 6.3 | 1.2 | 58 | ○ | 69.6 |
| Comp.ex.11 | 100 | — | 143 | 21 | 8.2 | 2.0 | 48 | x | 96 |
| Example 9 | 25 | PET | 140 | 30 | 2.1 | 0.6 | 61 | | — |
| Example 10 | 25 | PET | 140 | 31 | 2.4 | 0.7 | 65 | Δ | — |

TABLE 4-continued

| | Non-woven fabric-making conditions | | | Physical properties of non-woven fabric | | | | | |
|---|---|---|---|---|---|---|---|---|---|
| | Blending proportion | Other | Treating temp. | Basis weight of non-woven fabric | Strength of non-woven fabric Kg/5 cm | | Bulkiness (B) | | |
| | % | fiber | °C. | g/m² | MD | CD (S) | cm³/g | Feeling | S · B |
| Comp.ex.12 | 25 | PET | 140 | 30 | 1.6 | 0.3 | 53 | Δ | — |
| Comp.ex.13 | 15 | PET | 140 | 29 | 1.7 | 0.4 | 55 | Δ | — |

As seen from the results, the non-woven fabrics obtained by using the conjugate fibers of Examples 7 and 8 according to the present invention had a high strength of non-woven fabric, both in the longitudinal direction (MD) and in the lateral direction (CD), a good bulkiness and a good feeling. Whereas, the non-woven fabrics obtained by using conjugate fibers of Comparative examples 10 and 11, had a weak strength in the lateral direction (CD) or an inferior bulkiness or feeling.

EXAMPLES 9 AND 10 AND COMPARATIVE EXAMPLES 12 AND 13

Conjugate fibers of side-by-side type having a component ratio of 1:1 and a single filament denier of 12 d/f were obtained by spinning under the following conditions:

polypropylenes (MFR: 9) as a high melting component and its extrusion temperature of 300° C.;

high density polyethylenes as a low melting component, indicated in Table 1 and its extrusion temperature: 240° C.; the total extrusion quantity of both the components: 200 g/min.; and a spinning die having a nozzle diameter of 0.6 mm and a number of nozzles of 350.

The resulting unstretched filaments were stretched to 4 times the original length at 110° C., followed by crimping, heat-treating at 100° C. for 5 min. in order to prevent shrinkage and cutting to a cut length of 38 mm), to obtain a hot-melt-adhesive conjugate fiber staple.

The resulting hot-melt-adhesive fiber staple (15 to 25% by weight was optionally blended with a polyethylene terephthalate fiber staple (85 to 75% by weight) having a single filament denier of 6 d/f and a fiber length of 51 mm, followed by passing through a carding machine and heat-treating the resulting web at 140° C. for 5 sec. by means of a suction band dryer, to obtain a non-woven fabric having the points of intersection of the hot-melt-adhesive fibers hot-melt-adhered. The characteristics of the raw material polyethylene, the non-woven fabric-making conditions, the characteristics of the non-woven fabrics, etc. are shown in Table 3 and Table 4.

As seen from the results, hot-melt-adhesive non-woven fabric containing 20% by weight or more of the conjugate fibers of Examples 9 and 10 of the present invention had a high strength of non-woven fabric, and a good bulkiness and feeling. Whereas, the non-woven fabric obtained by using the conjugate fibers of Comparative example 12, and the hot-melt-adhesive non-woven fabric obtained by using the conjugate fibers of the present invention, but not containing the conjugate fibers in a quantity of 20% by weight or more, as in Comparative example 13, had a weak strength in the lateral direction (CD).

Effectiveness of the Invention

As apparent from Examples, when the hot-melt-adhesive conjugate fibers of the present invention obtained by using a specific polyethylene as the low-melting component of conjugate fibers are processed into a non-woven fabric, a non-woven fabric having a high strength, a good bulkiness and feeling is provided.

What we claim is:

1. A non-woven fabric containing 20% by weight or more of the following hot-melt-adhesive conjugate fibers and having the points of intersection of the fibers hot-melt-adhered with the polyethylene as the low melting point component in the conjugate fibers of the hot-melt-adhesive conjugate fibers:

said hot-melt-adhesive conjugate fibers being those of side-by-side type or sheath-and-core type, composed of a high melting pint component of a polypropylene or a polyester and a low melting point component of a methyl branched polyethylene, said methyl branched polyethylene continuously forming at least one portion of the fiber surface in the direction of the fibers, said methyl branched polyethylene having up to 1.5 methyl branch/1,000 C in the molecular chain, a density of 0.950 to 0.965 g/cm³ and a Q value (weight average molecular weight (Mw)/number average molecular weight (Mn)) of 4.5 or less.

2. A non-woven fabric according to claim 1, wherein said hot-melt-adhesive conjugate fiber has a finess of single filament of 0.5 to 3 denier and a number of crimps of 10 to 20 crimps/25 mm, and said non-woven fabric has a strength in a cross direction of 1.4 kg/5 cm or more and a bulkiness of 60 to 69 cm³/g.

3. A non-woven fabric according to claim 1, wherein said hot-melt-adhesive conjugate fiber has a finess of single filament of 0.5 to 3 denier and a number of crimps of 10 to 20 crimps/25 mm, wherein the product (S·B) of (i) a strength (S) (kg/5 cm) in a cross direction of said non-woven fabric and (ii) a bulkiness (B) (cm³/g) of said non-woven fabric, is 77 or more.

4. A non-woven fabric according to claim 1, wherein said hot-melt-adhesive conjugate fiber has a finess of single filament of 0.5 to 3 denier and a number of crimps of 10 to 20 crimps/25 mm, and said non-woven fabric has a strength in a cross direction of 1.1 to 1.4 kg/5 cm and a bulkiness of 70 cm³/g or more.

5. A non-woven fabric containing 20% by weight or more of the following hot-melt-adhesive conjugate fibers and having the points of intersection of the fibers hot-melt-adhered with the polyethylene as the low melting point component in the conjugate fibers of the hot-melt-adhesive 5 conjugate fibers:

said hot-melt-adhesive conjugate fibers being those of side-by-side type or sheath-and-core type, composed of a high melting point component of a polypropylene or a polyester and a low melting point component of a polyethylene, said polyethylene continuously forming at least one portion of the fiber surface in the direction of the fibers, wherein said polyethylene has a density of 0.950 to 0.965 g/cm$^3$ and a Q value (weight average molecular weight (Mw)/number average molecular weight ($M_n$)) of 4.5 or less, further wherein said polyethylene is a copolymer of ethylene with an α-olefin of 4 or more carbon atoms.

* * * * *

UNITED STATES PATENT AND TRADEMARK OFFICE

CERTIFICATE OF CORRECTION

PATENT NO. : 5,798,305

DATED : August 25, 1998

INVENTOR(S) : Shingo Horiuchi

It is certified that error appears in the above-identified patent and that said Letters Patent is hereby corrected as shown below:

Column 14, line 62, delete "5".

Signed and Sealed this

Sixteenth Day of February, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,798,305
DATED : August 25, 1998
INVENTOR(S) : Shingo Horiuchi

It is certified that error appears in the above-identified patent and that said Letters Patent is hereby corrected as shown below:

Column 14, line 28, delete "pint" and insert therefor: ---point---.

Signed and Sealed this

Sixth Day of April, 1999

*Attest:*

*Attesting Officer*

Q. TODD DICKINSON

*Acting Commissioner of Patents and Trademarks*